United States Patent [19]

Rusch et al.

[11] 4,206,430

[45] Jun. 3, 1980

[54] BIPOLAR PROTECTIVE SWITCH

[75] Inventors: Arthur Rusch, Emmenbrücke; Josef Flory, Reussbühl, both of Switzerland

[73] Assignee: Weber AG Fabrik Elektrotechnischer Artikel und Apparate, Switzerland

[21] Appl. No.: 891,389

[22] Filed: Mar. 29, 1978

[30] Foreign Application Priority Data

Mar. 31, 1977 [CH] Switzerland ..... 4056/77

[51] Int. Cl.[2] ..... H01H 83/00; H01H 73/48; H01H 75/12

[52] U.S. Cl. ..... 335/20; 335/10; 335/23; 335/35

[58] Field of Search ..... 335/9, 10, 20, 23, 24, 335/25, 35, 185, 155

[56] References Cited

U.S. PATENT DOCUMENTS

| | | | |
|---|---|---|---|
| 2,810,048 | 10/1957 | Christensen | 335/35 X |
| 3,680,014 | 7/1972 | Wilkinson | 335/25 X |
| 3,938,065 | 2/1976 | Ellenberger | 335/35 X |
| 3,946,345 | 3/1976 | Gryctko et al. | 335/10 X |
| 4,079,345 | 3/1978 | Pietsch | 335/10 |

*Primary Examiner*—Fred L. Braun

*Attorney, Agent, or Firm*—Browdy and Neimark

[57] ABSTRACT

A bipolar protective switch has a two-piece housing. An electromagnet constitutes the actuating device made either in the form of a zero voltage actuator or an excess current actuator. The armature of the electromagnet drops in the event of a voltage failure or is attracted if an excess current appears, thus disconnecting the switch. The switch can be turned back on again only after the voltage returns or normal current returns by the actuating device. A rocker is disposed on the narrow upper surface between the two pieces of the housing as the actuating member. The electromagnet and connecting members are disposed on the underside of the housing, a portion of the electromagnet being located between the two pieces of the housing. A support of an insulating material, is disposed in the housing upon which support connecting members are disposed. Two fixed contact members located side by side and two movable contacts, as well as a lever which is common to the two movable contacts is swivelable, and is subject to the force of a spring, the lever being connected to the rocker by a yoke. The lever is lockably connected with one arm of a two-armed release lever disposed on the support, the other arm being effectively connected with a release rod of the electromagnet.

10 Claims, 6 Drawing Figures

BIPOLAR PROTECTIVE SWITCH

BACKGROUND OF THE INVENTION

This invention relates to a bipolar protective switch provided with a two-piece housing of narrow design. More particularly, the present invention relates to such a switch which includes an actuating member, connecting members and an actuating device including an electromagnet. The actuating device is designed either as a zero voltage actuator or overvoltage actuator operatively arranged so that the armature of the electromagnet is dropped in the event of a voltage failure or is attracted when there is excess current, actuating the switch, so that when the voltage is restored or normal current returns, the switch can only be closed by operation of the actuating device.

A push-button actuated switch of the type described hereinabove is known, the switch being provided with two contact bridges, the bridges being disposed one above the other in the longitudinal direction of the housing and connected together mechanically by a slider, serving to connect a contact bridge or the two wires to be switched. The contact bridge or one of the contact bridges is disposed swivelably and axially displaceably on a switch rod connected rigidly to the push button, and having an arm which is latchable with a holding nose actuatable by the armature of the electromagnet which is likewise disposed in the lengthwise direction of the housing beside the contact bridge. The known switch requires a relatively large housing, has a plurality of individual components, and uses a plurality of switch components in the housing, especially for mounting and support. This arrangement makes the manufacture of this particular type of switch more difficult. Moreover, in the known switch, the terminals are not easily accessible in simple fashion and in particular are not arranged uniformly in a single plane.

SUMMARY OF THE INVENTION

It is the principal object of the present invention to provide a bipolar protective switch of the type described hereinabove which is a compact arrangement of a relatively small number of components and is produced with reliable electrical separation of the two contacts.

It is another object of the present invention to provide a bipolar protective switch of the type described hereinabove in which the two housing pieces essentially constitute only a shell, not supporting the components.

It is an additional object to provide a bipolar protective switch of the type described hereinabove in which the components of the switch mechanism are the same both for zero voltage actuation and for excess current actuation.

According to the invention, the bipolar protective switch is characterized by the fact that the actuating member is a rocker mounted on a narrow upper surface between the two pieces of the housing, and by the fact that the electromagnet and the connecting members are disposed on a narrow underside of the housing, a portion of the electromagnet being inserted between the two pieces of the housing. In accordance with additional salient features, a support made of an insulating material is disposed in the housing, upon which the connecting members are disposed and which is provided, in a position essentially parallel to the narrow upper side of the housing, in a side-by-side position.

Two fixed contact members and two movable contact members, as well as a lever which is common to the two movable contact members, is swivelable, and subjected to the force of a spring. The lever is connected to the rocker by a yoke resembling a knee joint. The lever further is latchable with one arm of a two-armed release lever disposed on the support, the other arm of the release lever being actively connected with a release rod abutting the electromagnet.

In a switch according to the invention, the housing serves only to hold the rocker and the electromagnet, while all other components are disposed on the common support. This allows efficient manufacture, since the switch, assembled on the support, need only be inserted into the housing. In addition, this design for the switch components, locating them on the support, ensures an optimal electrical separation of the circuits. The support can be provided with appropriate partitions, ridges, and the like.

The arrangement of an electromagnet with a switch rod, acting on an actuating lever, makes it possible to provide individually, by appropriate design of the magnet (yoke, armature, armature spring) so that the switch operates either with electromagnetic zero voltage actuation or electromagnetic excess current actuation.

The fact that the electromagnet is disposed projecting from the narrow underside of the housing for zero voltage actuation or excess current actuation results in a favorable utilization of the available space, because the connecting members require a certain amount of space. Advantageously, the connecting members on the input side are disposed on one side of the electromagnet and the output connecting members on the other side of the electromagnet, within the maximum lengthwise dimension of the housing.

A favorable utilization of space is also achieved by the essentially horizontal arrangement of the contact elements and the swivelable lever to actuate the movable contact members. The contact members associated with the two circuits can be disposed very close to one another on the support, since the above-mentioned design of these supports allows reliable electrical separation. Thus, the switch of the present invention can be made very narrow despite the fact that the contact members of the two circuits are located side by side.

A further advantage of the switch constructed according to the present invention resides in the fact that after the swivelable lever has been released following the appearance of zero voltage or an excess current, the lever executes a swiveling movement which lifts the movable contact members away from the fixed contact members; this movement is transmitted by a yoke to the rocker. In this way, the position of the rocker advantageously indicates the position of the switch.

It is also advantageous that a thermal actuator, for example a bimetallic member, can be disposed simply on the support, the member acting upon the release lever articulated to the swivelable lever when the bimetallic member is deflected as a result of having a high current pass through it, thus resulting in release of the latch and actuation corresponding to electromagnetic actuation.

BRIEF DESCRIPTION OF THE DRAWINGS

Embodiments of the protective switch according to the present invention are discussed hereinbelow, reference being made to the drawings.

DETAILED DESCRIPTION OF THE PREFERRED EMBODIMENT

The bipolar protective switch as illustrated in FIGS. 1-4 with zero voltage actuation is provided with a housing 1, whose upper side supports the actuating member of the switch shown in the form of a rocker 2, with an electromagnet 3 for zero voltage actuation of the switch being disposed on the underside of the switch. The electromagnet has a support 4 provided for supporting other parts of the switch.

Figure 4:
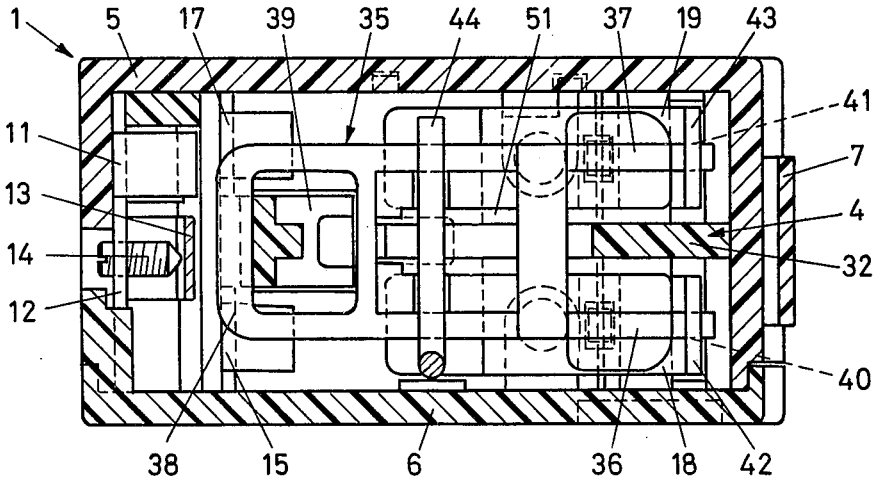
FIG. 4 is a sectional view of the closed switch of FIG. 1, the section being taken through the closed switch along section line IV—IV in FIG. 1.

The housing is made in known fashion in two pieces and, as best seen in FIG. 4, has a housing shell 5 and a cover 6. The housing shell 5 is provided with ribs 7 (FIGS. 1, 4) on its narrow sides, these ribs being fastened only at their ends to the housing shell 5, being freely supporting therebetween. The ribs 7 are made integral with the housing shell 5 and serve to automatically clamp a switch inserted into an opening in a plate. The rocker 2 is swivelably mounted between the housing shell 5 and the cover 6, (FIGS. 1, 2) by pins 8 located in corresponding blind holes. The underside of the housing 1 is provided with a collar-like projecting portion 9, in which the electromagnet 3 is held and retained by projections 10. The support 4, disposed between the housing shell 5 and the cover 6, is made of an insulating material and is provided with a first connecting lug 11 (FIGS. 1, 4), this lug projecting downward from the housing 1 and being designed inside the housing as a holder 12 for a strip-shaped bimetallic member 13. An adjustment screw 14 screwed into the holder 12, serves to adjust the bimetallic member 13.

Figure 1:
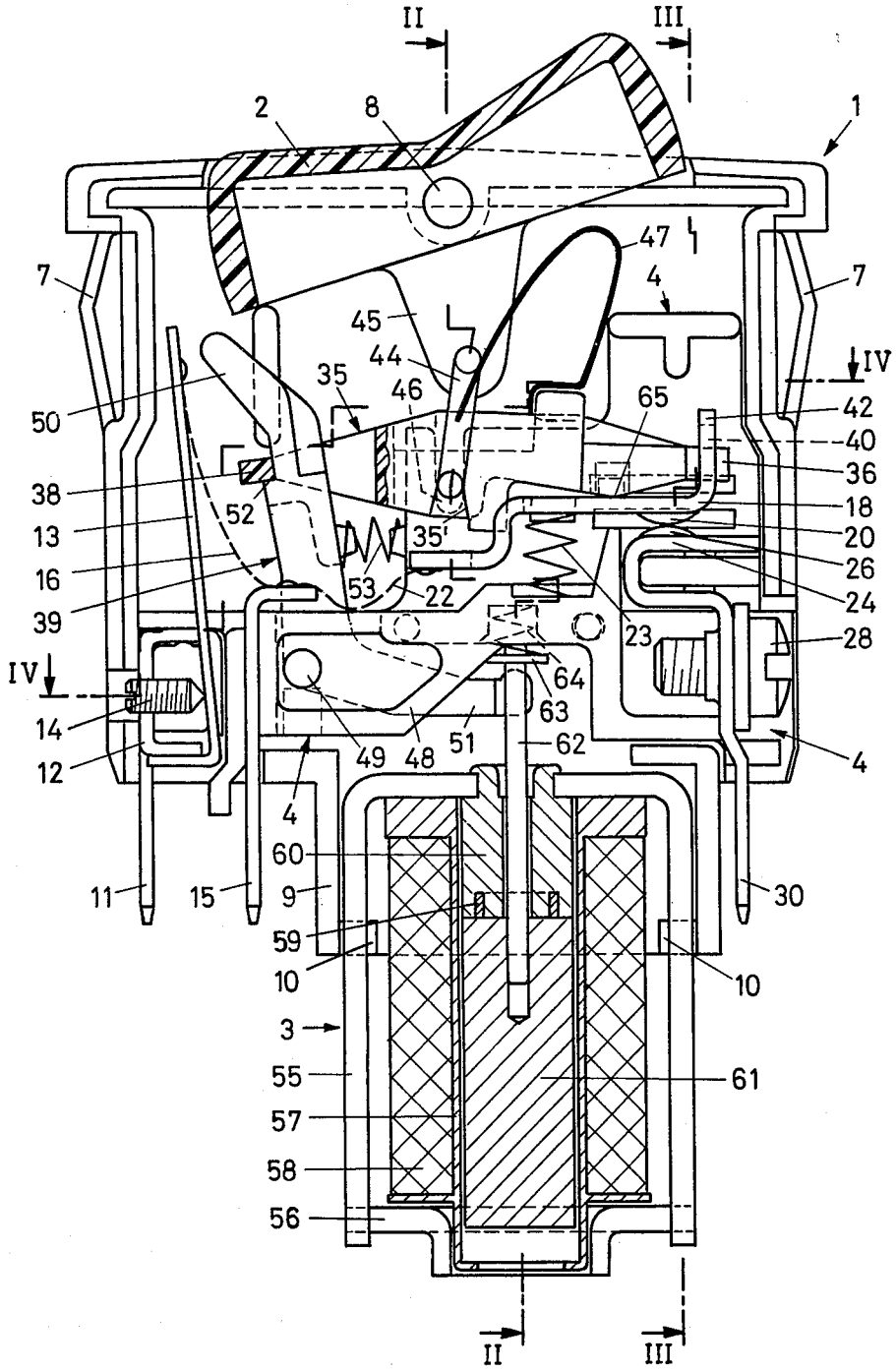
FIG. 1 is a partial, cutaway view of an exemplary embodiment of a switch in accordance with the present invention with zero voltage actuation, in its ON position.

A second connecting lug 15, insulated from the first connecting lug 11 and the holder 12 for the bimetallic member, is disposed in the support 4, this lug being connected in an electrically conducting manner with the bimetallic member 13 by a piece of braid 16, shown in FIG. 1. In addition to the second connecting lug 15, a third connecting lug 17 (FIG. 4), not visible in FIG. 1, is located in the same plane in the support 4, this third lug 17 being insulated from the second lug 15.

Furthermore, two movable contacts 18 and 19 are disposed side by side in the support 4 only one of these elements being visible in FIG. 1. Each of the movable contacts 18, 19 is provided with a respective contact member 20 or 21, and is connected in an electrically conducting manner with the corresponding connecting lug 15 or 17 by an additional piece of braid 22, as indicated in FIG. 1. Furthermore, each of the contacts 18, 19 is subjected to pressure from a contact spring 23 (FIG. 1), abutting the support 4.

In the support 4, two fixed contacts 24 and 25, each provided with a respective contact member 26 and 27 are disposed in the narrow side of the housing 1 opposite the first connecting lug 11. The downwardly extending portions of contacts 24, 25 are each provided with a screw connection 28 or 29, and are each provided with a fourth connecting lug 30 and a fifth connecting lug 31, projecting downward from the housing 1.

The screw 28, 29 and the fourth and fifth connecting lugs 30 and 31 serve to connect the present switch with two terminals of a power source, for example a source of line voltage. Bipolar switching connection of a consumer is accomplished, on the one hand, by the first connecting lug 11 connected to the movable contact 18 by the bimetallic member 13 and, on the other hand, by the third connecting lug 17 which is connected with the other movable contact 19. An additional consumer, which is not intended to impose a stress on the bimetallic member 13, can be connected bipolarly to the above-mentioned third connecting lug 17 as well as to the second connecting lug 15.

Figure 3:
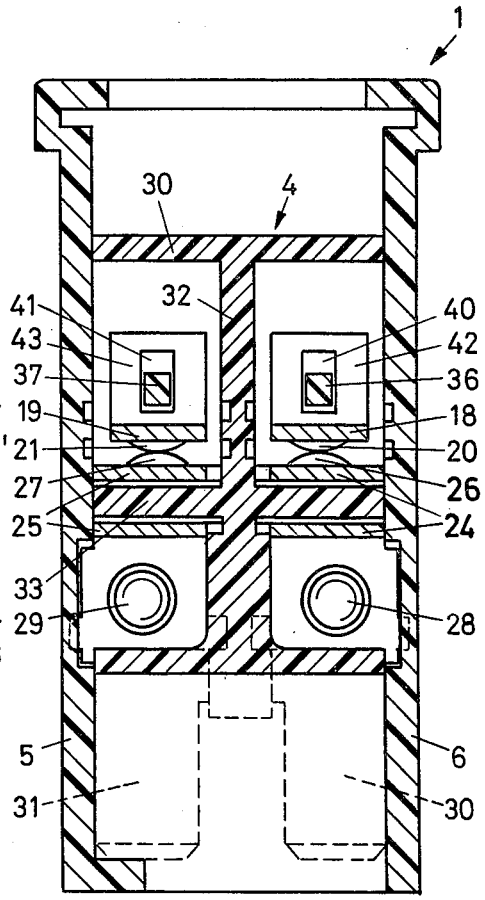
FIG. 3 is a sectional view of the closed switch of FIG. 1, the section being taken along section line III—III in FIG. 1.

It is clear from FIG. 3 that lengthwise rib 32 and cross-rib 33 of the support 4 insulate the two contact sets defined by contacts 18, 24 and by contacts 29, 25 as well as their screw connections 28 and 29 from one another and also, together with the housing shell 5 and the cover 6, form switching chambers for the above-mentioned contact sets.

In addition, a latch-lever 35, made of an insulating material, is disposed swivelably and lengthwise displaceably in the housing 1, this lever being substantially U-shaped, as shown in FIG. 4, whereby two legs 36 and 37 are separated by the lengthwise rib 32. A yoke 38 of the latch lever 35 engages a release lever 39 described hereinbelow, while the free ends of the two legs 36, 37 are in openings 40, 41, these openings being provided in upwardly bent sections 42, 43 of movable contacts 18, 19.

A U-shaped metal yoke 44 fits loosely with one leg in holes 2′ of side tabs 45 of the rocker 2 designed as a hollow body, and has its other leg, which likewise fits loosely in recesses 35′ of the two legs 36, 37 of the latch lever 35, in a lengthwise slot 46 of the lengthwise rib 32 of the support 4. A U-shaped rocker spring 47, fastened to the latch lever 35, abuts the upper leg of the yoke 44 with its free end.

The above-mentioned actuating lever 39, made of an insulating material, is swivelably mounted in lateral cheeks 48 of the support 4 by pins 49, and is provided with two arms 50 and 51. The end of the upwardly extending arm 50 is intended to be actuated by the bimetallic member 13, deflecting rightward under the influence of a flow of current. Furthermore, the one arm 50 is provided with a shoulder 52 upon which the yoke 38 of the latch lever 35 rests when the switch is in the ON position shown in FIG. 1. As is described hereinbelow, the other arm 51 is cooperatively connected with the electromagnet 3. A return spring 53 disposed between the support 4 and the release lever 39 presses the release lever against the yoke 38 of the latch lever 35.

Figure 2:
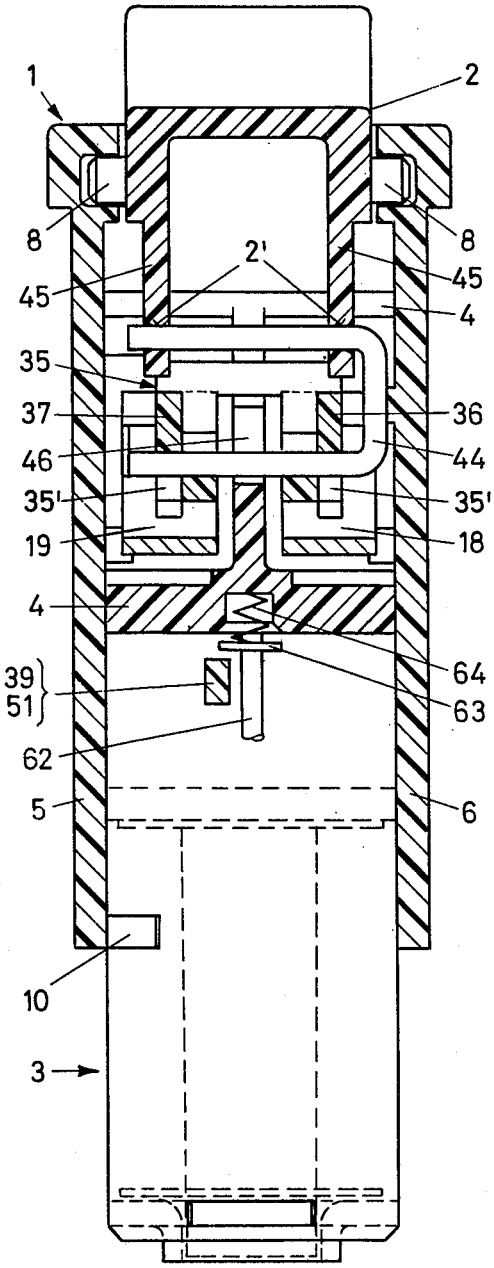
FIG. 2 is a cross-sectional view of the closed switch of FIG. 1, the section being taken along section line II—II in FIG. 1.

Zero voltage actuation of the present switch involves the above-mentioned electromagnet 3, mounted in the housing 1 between the connecting lugs 11, 15, 17, 30, and 31. The electromagnet 3 includes a yoke 55, a lower yoke plate 56 and a coil body 57 inserted in the yoke plate 56, this body supporting a winding 58. A core 60, firmly connected to the yoke 55 and provided with a short circuiting ring 59 is disposed in the coil body 57. In addition, an axially movable armature 61 is disposed in the coil body 57, to which armature a release rod 62, extending coaxially through the core, is firmly attached, whereby the release rod 62 passes laterally beside the arm 51, as shown in FIG. 2. Above the arm 51, the release rod 62 is provided with a disc 63, which is immovable in the lengthwise direction of the release rod, this disc serving, on the one hand, as a support for a magnet spring 64 abutting the support 4 and, on the other hand, when the release rod 62 moves downward, comes to rest on the arm 51 of the lever 39 depressing the latter. The winding 58 is electrically connected inside the housing 1 in a manner not shown with the two fixed contacts 24 and 25 and is thus energized with the supply of voltage fed to the switch.

The operation of the switch shown in FIG. 1 in the ON position when the supply voltage (line voltage) is applied is as follows:

As a result of the flow of current through the winding 58 of the electromagnet 3, the armature 61 is attracted and comes to rest against the core 60, so that release rod 62 is in the upper position shown, against the pressure of the magnet spring 64. The contact pressure of movable contacts 18, 19 on the fixed contacts 24, 25 is produced by the contact spring 23, while the movable contact 18, shown in FIG. 1, comes to rest on the latch lever 35 in a position limited and defined by abutment point 65 and thus presses upon the fixed contact under the influence of the lever. The above-mentioned abutment point 65 is incapable of yielding under the pressure of the contact spring 23, because the latch lever 35 is prevented, on the one hand, by the yoke 44 from moving upward and, on the other hand, is prevented by the shoulder 52 of the release lever 39 from moving downward.

Figure 5:
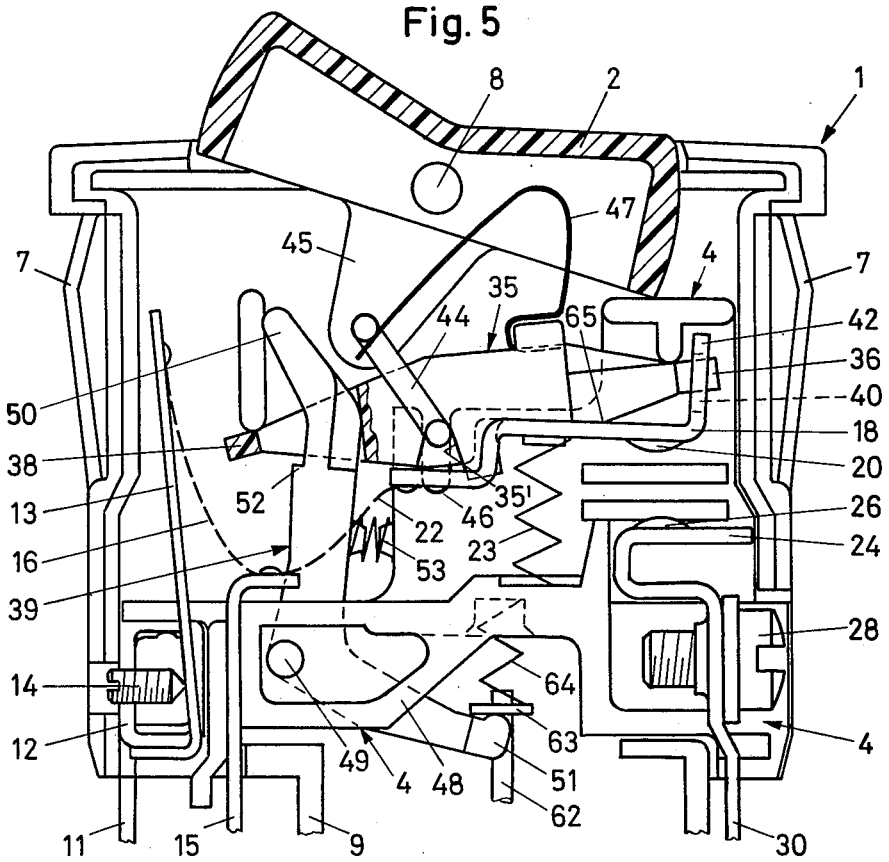
FIG. 5 is a view of a portion of the switch according to FIG. 1, in its open, OFF position.

If the line voltage drops below a given value or disappears completely, the magnet spring 64 abruptly pushes the release rod 62 downward and causes the release lever 39 to swivel clockwise about the axis of its pins 49. This causes the yoke 38 of the latch lever 35 to unlock from the shoulder 52 of the release lever 39; in other words, the latch lever 35 can only carry out a swiveling movement counterclockwise. A swiveling movement of this kind is produced by the contact spring 23 by virtue of its pressure upon the movable contact 18 and the abutment point 65. Abutment point 65 is accordingly displaced upward, so that movable contact members 20, 21 lift off the fixed contact members 26, 27. The swiveling movement of the latch lever 35 causes the rocker spring 47 to exert an increased lateral pressure on the yoke 44, this yoke swiveling through the dead point clockwise, thus tilting the rocker 2 to the other end position corresponding to the OFF position. In this manner, the latch lever 35 can also be displaced upward, so that the movable contact members 20, 21 can move further away from fixed contact members 26, 27 or can be torn away from them in the event the contacts have become welded together. The positions of the individual members with the switch in the OFF position produced by insufficient voltage is shown in FIG. 5 wherein only the most important parts of FIG. 1 are illustrated.

The switch can only be turned to the ON position after being triggered by insufficient voltage, after complete line voltage returns, in other words when the armature 61 is attracted. In the OFF position, as shown in FIG. 5, the tilting rocker 2 merely causes the yoke 38 of the latch lever 35 to deflect downward, since the shoulder 52 of the release lever 39 is not present as a support in the vicinity of the yoke 38. Pressing the latch lever 35 downward on the movable contacts 18, 19 is not possible. When the rocker 2 is released, the latter immediately returns to the OFF position shown in FIG. 5 under the influence of the pressure of the rocker spring 47 on the yoke 44.

When complete line voltage returns, the yoke 38 of the latch lever 35 rests upon the shoulder 52 of the release lever 39 when the rocker 2 is actuated, so that the latch lever 35 and hence the movable contacts 18, 19 swivel clockwise to the ON position, for example as shown in FIGS. 1 and 2.

On the other hand, it is not possible for the line voltage to reach the consumer when it returns. Return of line voltage merely causes the release lever 39 to swivel under the pressure of the return spring 53 to the position shown in FIG. 1. The latch lever 35 and the movable contacts 18, 19 remain in the position shown in FIG. 5 under the influence of the contact spring 23 and the position of the yoke 44. The contacts are closed only when the rocker 2 is actuated.

If the switch shown in FIG. 1 is turned OFF by hand, in other words by actuating the rocker 2, the yoke 44 is displaced upward in the lengthwise slot 46 of the support 4 after passing the dead point. The latch lever 35 then slides upward and swivels counterclockwise, together with the movable contacts 18, 19 so that the contacts are opened abruptly as soon as the yoke 44 has swiveled past its dead point indicated by the vertical axis.

Actuation of the switch corresponding to the zero voltage triggering described above can also be accomplished by the bimetallic member 13, when the latter is considerably heated by an excess current and deflects in the direction of the release lever 39. The effect of the bimetallic member 13 on the arm 50 of the release lever 39 is the same as that of the magnet spring 64 on its arm 51, whereby the affects on the release lever 39 are independent of each other in such manner that manual resetting is only possible if the line voltage has returned and the bimetallic member 13 has cooled off.

Figure 6:
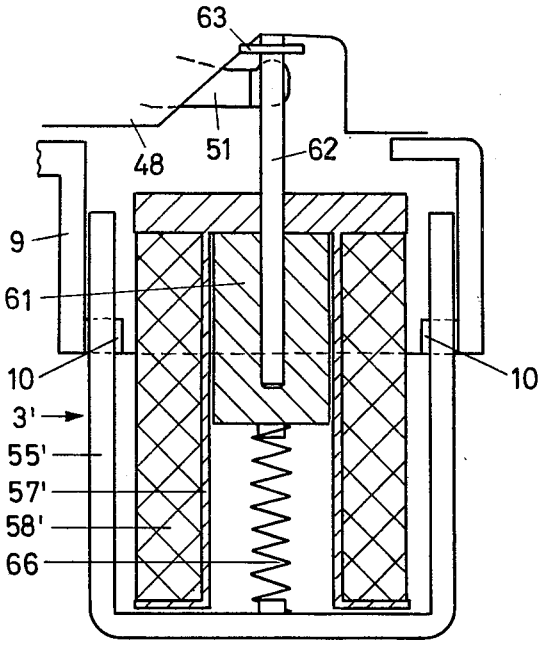
FIG. 6 is a view of an electromagnetic arrangement for excess current actuation of the switch of FIG. 1.

The protective switch shown in FIG. 1 can also be provided with the electromagnet arrangement shown in FIG. 6, which is provided with an electromagnetic excess current actuation, which is desirable to separate the circuits in the event that a short circuit develops. An electromagnet 3' is mounted on a yoke 55' which is closed in the outside of the switch, this yoke being inserted once again in the collar-shaped projecting housing part 9 and held in place by the projections 10. A coil body 57' is disposed in a yoke 55' this body supporting a winding 58'. The axially movable armature 61 is disposed in the coil body 57', and the release rod 62 provided with the disc 63 is connected with the armature 61. A spring 66 which abuts the yoke 55' presses the armature 61 against the upper flange of coil body 57', as long as the current flowing through coil 58' does not exceed a specified maximum value.

When excess current appears, especially in the form of a short circuit, the armature 61 is pulled downward against the pressure of the spring 66 so that the disc 63 swivels the release lever 39 and pressure of the arm 51, releasing the switch in the manner described above. The switch can only be returned to the ON position when there is no longer any excess current and the rocker 2 (FIGS. 1, 5) is actuated.

It is clear that in the switches described hereinabove impediment of the process of turning the switch OFF and ON is eliminated by the switching-on technique; in other words, the switches described are provided with a free release.

It is to be appreciated that the foregoing description and accompanying drawing figures have been set out by way of example, not by way of limitation. Other embodiments and variants are possible without departing from the spirit and scope of the present invention, its scope being defined in the appended claims.

What is claimed is:

1. In a bipolar protective switch with a two-piece housing, the housing including an actuating member and connecting members; an actuating device including an electromagnet having an armature and a release rod, the device being made either in the form of a zero voltage actuator or an excess current actuator, whereby the armature of the electromagent drops out in the event of a voltage failure or is attracted if an excess current appears, thus disconnecting the switch, so that the switch can be turned back on again, only after voltage returns or normal current returns, by the actuating member, the improvement wherein said actuating member is a rocker disposed on a narrow upper surface between said two pieces of said housing; wherein said electromagnet and said connecting members are disposed on a narrow underside of said housing, a portion at least of said electromagnet being located between said two pieces of said housing; and including a support of insulating material disposed in said housing and upon which said connecting members are disposed; two fixed contact members located side-by-side in a position substantially parallel to a narrow top surface of said housing; a spring; two movable contacts and a swivelable lever common to said two movable contacts; and subject to the force of said spring, said swivelable lever being connected to said rocker by a yoke in the manner of a knee joint, and which swivelable lever is lockably connected with one arm of a two-armed release lever disposed on said support, the other arm of said release lever being connected with said release rod of said electromagnet; and wherein only said rocker and said electromagnet are directly supported by said housing, all other components being supported be said support of insulating material.

2. A protective switch according to claim 1, wherein those of said connecting members which are input side members are disposed on said narrow underside of said housing on one side of said electromagnet and those of said connecting members which are output side members are disposed on the other side of said electromagnet within maximal lengthwise dimension of said housing, said electromagnet extending beyond said housing in its lengthwise direction.

3. In a bipolar protective switch with a two-piece housing, the housing including an actuating member and connecting members; an actuating device including an electromagnet having an armature and a release rod, the device being made either in the form of a zero voltage actuator or an excess current actuator, whereby the armature of the electromagent drops out in the event of a voltage failure or is attracted if an excess current appears, thus disconnecting the switch, so that the switch can be turned back on again, only after voltage returns or normal current returns, by the actuating member, the improvement wherein said actuating member is a rocker disposed on a narrow upper surface between said two pieces of said housing; wherein said electromagnet and said connecting members are disposed on a narrow underside of said housing, a portion at least of said electromagnet being located between said two pieces of said housing; and including a support of insulating material disposed in said housing and upon which said connecting members are disposed; two fixed contact members located side-by-side in a position substantially parallel to a narrow top surface of said housing; a first spring; two movable contacts and a swivelable lever common to said two movable contacts and subject to the force of said first spring, said swivelable lever being connected to said rocker by a yoke in the manner of a knee joint, said swivelable lever being latchably connected with one arm of a two-armed release lever disposed on said support, the other arm of said release lever being connected with said release rod of said electromagnet; and wherein said yoke which connects said rocker to said swivelable lever is inserted with its upper leg in holes of said rocker and with its lower leg in recesses of said swivelable lever, said upper leg of said yoke being subject to the action of a second spring which exerts pressure in a lengthwise direction of said swivclable lever and is anchored on said support; a lower leg of said yoke being guided in a slot of a rib on said support, said slot running in a lengthwise direction of said housing.

4. A protective switch according to claim 3, wherein said swivelable lever is made substantially U-shaped and fits with its leg ends in openings in said movable contacts, while said yoke abuts a shoulder of said release lever in a locked position.

5. A protective switch according to claim 4, wherein said movable contacts are disposed above fixed contacts, said movable contacts are each subject to the action of said first spring pressing upward, and abut legs of said swivelable lever at a given point, said point being located between leg ends of said swivelable lever and said first spring tending to force said movable contacts upward, whereby holes in said swivelable lever which accept said yoke are disposed between lockable yoke means and said first spring.

6. A protective switch according to claim 4, wherein said one arm of said release lever is located approximately in a lengthwise direction of said housing and is subject to the action of an additional spring, said additional spring pressing a shoulder of said one arm in a locked position against said swivelable lever.

7. A protective switch according to claim 6, wherein said other arm of said release lever is disposed at least approximately vertically with respect to said release rod of said electromagnet, said release rod being provided with a stop member for said other arm and is subject to the action of further springs so that said stop member presses said other arm when voltage fails or lifts said stop member away from said other arm when there is no excess current.

8. A protective switch according to claim 7, wherein said stop member is a disc.

9. A protective switch according to claim 3, wherein said contacts are seperated electrically from one another by ribs on said support, said ribs forming switching chambers together with said two pieces of said housing.

10. A protective switch according to claim 3, including a bimetallic element which is to be heated by current to be switched, located parallel to said one arm of said release lever and abutting said one arm of said release lever when it is in a deflected position and releasing the latch with said swivelable lever.

* * * * *